United States Patent [19]

Lester

[11] Patent Number: 5,047,000

[45] Date of Patent: Sep. 10, 1991

[54] ATTACHMENT FOR FORMING ENVELOPES

[75] Inventor: Robert Lester, Chicago, Ill.

[73] Assignee: Outlook Envelope Company, Huntley, Ill.

[21] Appl. No.: 441,363

[22] Filed: Nov. 27, 1989

[51] Int. Cl.[5] ..... B31B 21/36; B31B 21/62

[52] U.S. Cl. ..... 493/231; 493/248; 493/249; 493/254

[58] Field of Search ..... 493/228, 229, 231, 232, 493/248, 249, 254, 264, 331, 418

[56] References Cited

U.S. PATENT DOCUMENTS

| | | | |
|---|---|---|---|
| 2,054,833 | 9/1936 | Potdevin | 493/254 |
| 3,079,144 | 2/1963 | Frei | 493/254 |
| 4,156,398 | 5/1979 | McDaniel | 493/331 |
| 4,338,085 | 7/1982 | Sullivan et al. | 493/254 |
| 4,504,260 | 3/1985 | Lillibridge | 493/249 |

*Primary Examiner*—William E. Terrell

*Attorney, Agent, or Firm*—Wallenstein, Wagner & Hattis, Ltd.

[57] ABSTRACT

A readily removable apparatus for use with an envelope blank-forming machine for the forming of envelopes from those blanks. The apparatus comprises an adhesive sprayer for applying adhesive on one side of a side flap of the envelope blank. It also includes an air lifter to lift a leading edge of the blank into engagement with a buckle bar. A plow folds the side flaps over a rear portion of the envelope blank, and rollers press the adhesive-covered side of the side flaps onto a rear portion of the blank to form an envelope.

9 Claims, 3 Drawing Sheets

ATTACHMENT FOR FORMING ENVELOPES

DESCRIPTION

Technical Field

The invention relates generally to an apparatus for the folding of paper blanks, and the forming of those blanks into envelopes. The apparatus is particularly suited to paper blanks used to manufacture envelopes commonly known as outside side seam envelopes.

BACKGROUND OF THE INVENTION

Outside side seam envelopes are used for a variety of purposes. Double outside side seam (DOSS) envelopes are made from a one-piece blank having a pair of side flaps. While the blank is flat, adhesive is applied to these side flaps. They are then folded over a rear portion of that blank. Together with a front portion of the blank, the folded and adhered blank forms an envelope. One example of such an envelope is the open-topped sleeve typically used to protect the minidisks used, with personal computers, to store data.

Typically, the machines on which outside side seam envelopes are made are multi-purpose machines, i.e., they are also suitable for the manufacture of other types of envelopes. One example of such multi-purpose machines is the Model RA-800, manufactured by the F. L. Smith Company, Duncansville, Pa. 16635. When the machine is being used to manufacture outside side seam envelopes, a special mechanism must be used. One such mechanism is known as the Double Outside Side Seam Mechanism, which is also manufactured by F. L. Smith for use with its "RA" series of machines.

The Smith Double Outside Side Seam Mechanism (DOSSM) is a relatively expensive unit. In addition, attaching the DOSSM to the RA-800 is a cumbersome and time consuming process. If a RA-800 without the DOSSM is already being used in the field, a skilled crew can require up to two weeks for its installation, including the time for necessary modifications to the frame of the RA-800. After the DOSSM has been installed on the RA-800, its removal and replacement can each require twenty or more man-hours. If the RA-800 is not dedicated solely to the manufacture of outside side seam envelopes, such removal may be necessary to enable the RA-800 to make other kinds of envelopes.

SUMMARY OF THE INVENTION

The invention is an apparatus for use in an envelope blank forming machine. Paper is fed through the machine, and a blanking die forms the outline of an envelope blank before folding. The present invention is a removable apparatus for forming envelopes from these envelope blanks. The blanks include a leading edge, side flaps, a rear portion, and a front portion.

The apparatus comprises adhesive application means for applying adhesive on one side of the side flaps of the envelope blank. It further comprises a buckle bar for urging the leading edge of the envelope blank upwardly. Means for folding the rear portion of the blank to a position overlying the front portion and means for folding the side flaps over the rear portion are also provided. Finally, the apparatus comprises roller means for pressing the adhesive-covered side of the side flaps onto the rear portion to form an envelope.

In an alternate embodiment of the invention, the adhesive application means of the apparatus comprises an adhesive sprayer. In another embodiment, the means for folding the side flaps comprises plow means. In still another embodiment, the apparatus includes means such as air lifting means for elevating the leading edge of the blank into engagement with the buckle bar.

The object of the invention is to provide an inexpensive attachment to a conventional blank forming machine. A further object is to provide an apparatus for forming outside side seam envelopes. Yet other objects of the invention include an apparatus which requires little time to attach and remove from an envelope blanking machine, which is simple in construction, and which is relatively inexpensive to manufacture.

DETAILED DESCRIPTION OF THE PREFERRED EMBODIMENT

The present invention is an apparatus for use with an envelope blank forming machine. In a conventional blank forming machine, such as the Model RA-800, manufactured by the F. L. Smith Company, paper is fed through the machine and a blanking die forms the outline of an envelope blank before folding.

Figure 1:
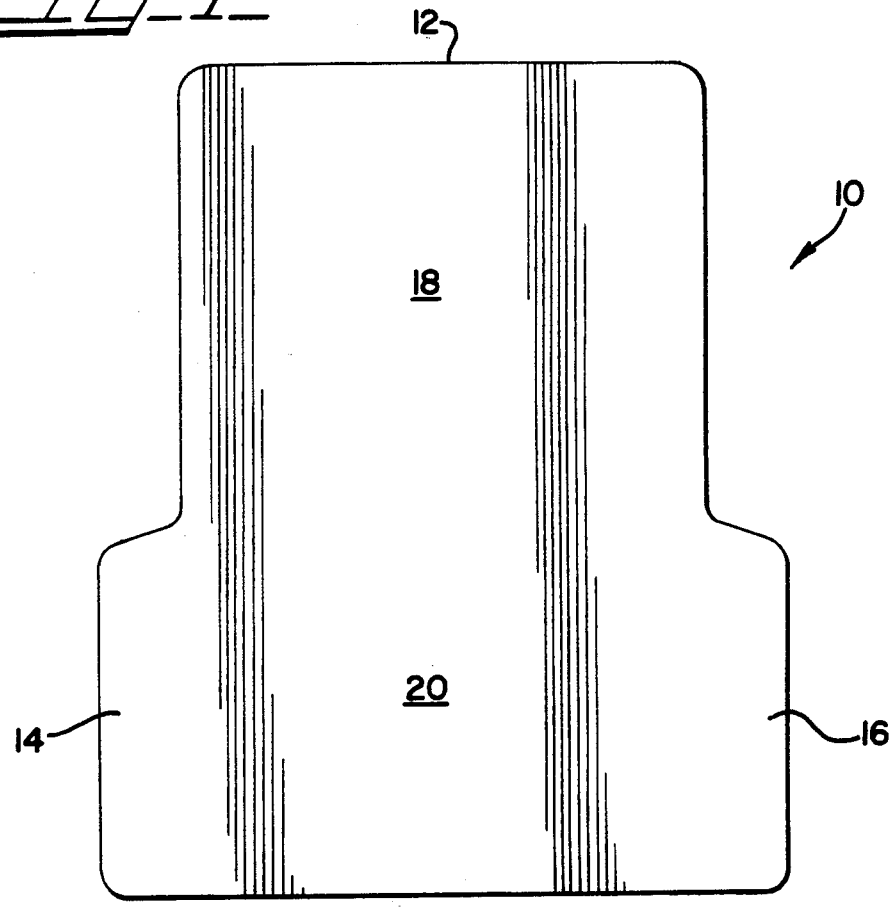
FIG. 1 is an overhead view of an envelope blank for making double outside side seam envelopes.

The present invention is preferably used to fold and manufacture a double outside side seam envelope, such as the open-topped sleeve that typically protects the datastoring minidisks used with personal computers. The blank used to manufacture such envelopes is shown in FIG. 1. As may be seen from that FIGURE, the blank 10 includes a leading edge 12, a pair of side flaps 14 and 16, a rear portion 18, and a front portion 20.

Figure 4:
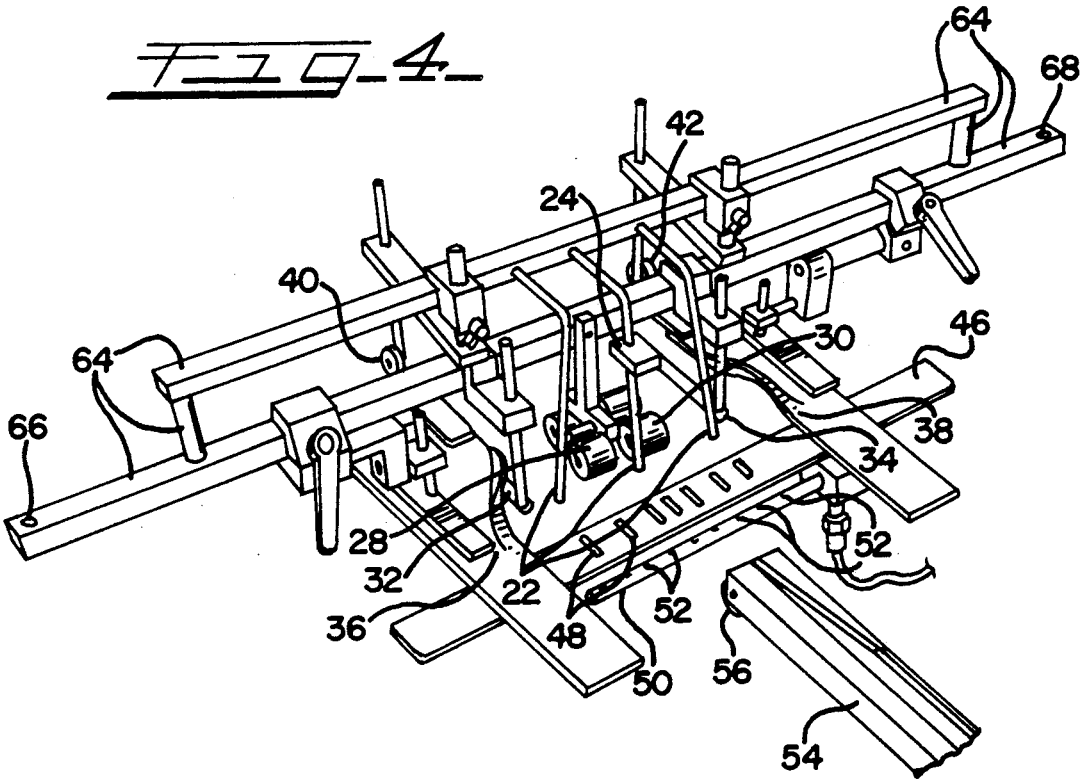
FIG. 4 is a perspective view of the components of the apparatus in accordance with the invention.

Referring now to FIG. 4, the perspective view of the apparatus is shown. The components of the apparatus include a buckle bar 22. In the preferred embodiment, this buckle bar 22 comprises three L-shaped, spaced-apart elements. The spacing between these three elements is sufficient to accommodate envelope blanks of various lengths. The center element of the buckle bar includes an adjustable stop 24. As will be explained below, this adjustable stop 24 may be raised or lowered along the center element to accommodate blanks for envelopes of various heights.

Figure 2:
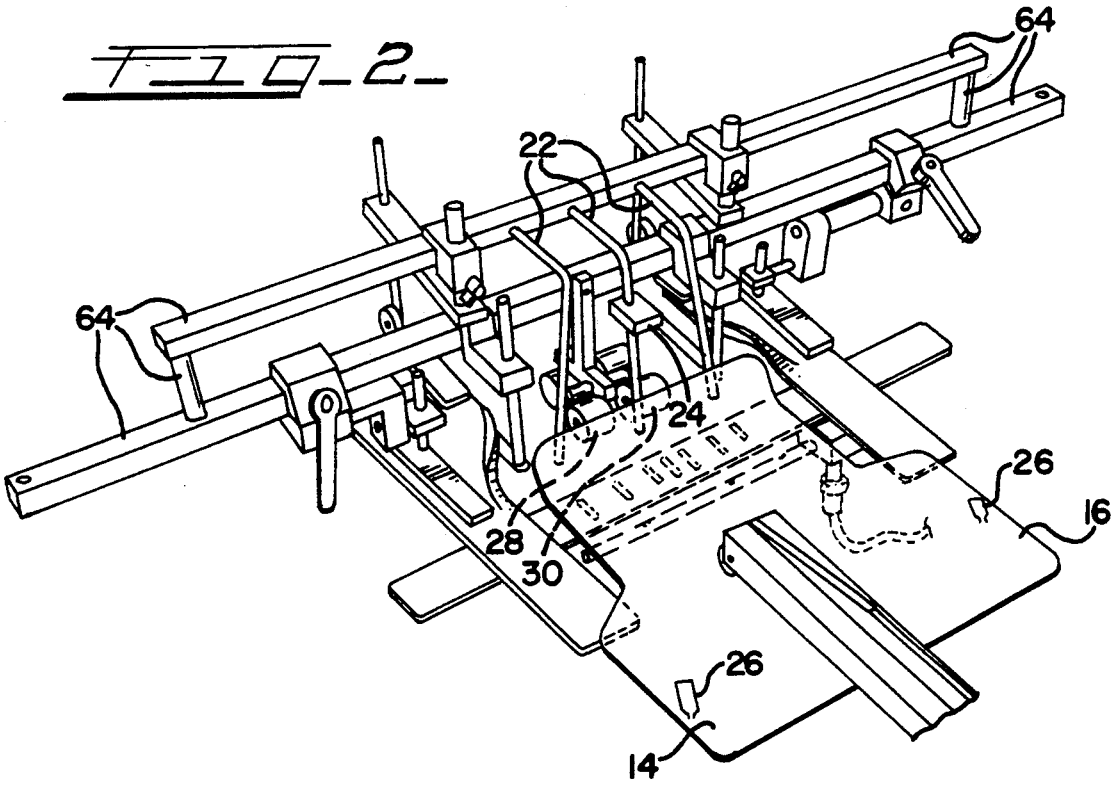
FIG. 2 is a perspective view of an apparatus in accordance with the invention, and showing an envelope blank as its leading edge engages the buckle bar of that apparatus.

Adhesive application means are provided for applying adhesive on one side of the side flaps 16 and 18 of the envelope blank 10. In the preferred embodiment and as shown in FIG. 2, the adhesive application means includes an adhesive sprayer or spray nozzle 26. The adhesive is conveyed, as appropriate, to this nozzle by a Valco VC 450/850 Pattern Control System, which is manufactured by Valco Cincinnati, 411 Circle Freeway Drive, Cincinnati, Ohio 45246.

Means are also provided for folding the rear portion 18 of the envelope blank to a position overlying the front portion 20. In the preferred embodiment, these means comprise a pair of friction drive rollers 28 and 30. Each of these drive rollers is made of an elastomeric material, includes a ball bearing, and is rotatably mounted upon a shaft.

The apparatus also includes means for folding the side flaps 14 and 16 of the envelope blank over its rear portion 18. In the preferred embodiment, these folding means include a pair of folder blades 32 and 34 and a pair of corresponding plow shears 36 and 38.

Roller means are also provided for pressing the adhesive-covered side of the side flaps 14 and 16 onto the rear portion 18 of the envelope blank 10 to form a finished envelope. In the preferred embodiment, these roller means are a pair of crease rollers 40 and 42. Each crease roller presses against one side flap as the blank 10 is advanced by the blank forming machine.

Figure 6:
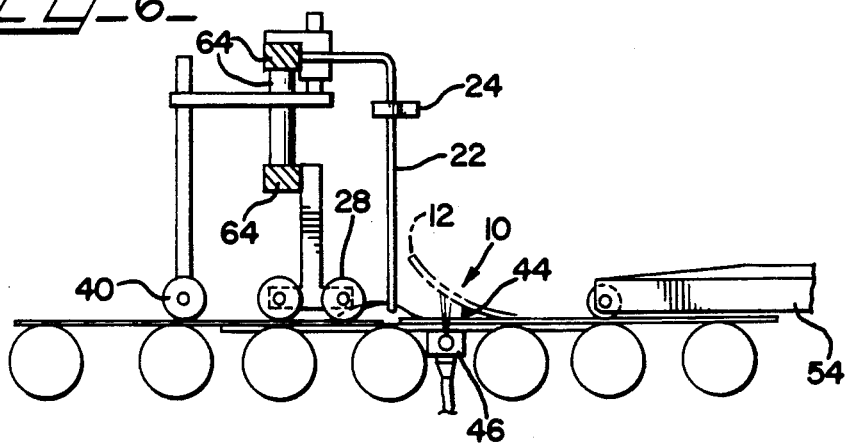
FIG. 6 is a side view of the apparatus in accordance with the invention installed on a blank forming machine, and as a blank is being elevated by air lifting means.

As may be seen in FIG. 6, the apparatus also includes means for elevating the leading edge 12 of the envelope blank 10 into engagement with the buckle bar 22. These means comprise a plurality of teflon tabs 44 projecting from the flat surface of the blank forming machine on which the envelope blanks are carried. The elevating means may also comprise air lifting means. As may be seen in FIG. 4, the air lifting means of this embodiment include a flat, orifice-containing bar 46 with a plurality of orifices 48. An air supply plenum 50, also having a plurality of orifices 52, provides air to the orifice-containing bar 46. In FIG. 4, plenum 50 is shown spaced apart from bar 46. In fact, however, this plenum abuts bar 46.

Figure 5:
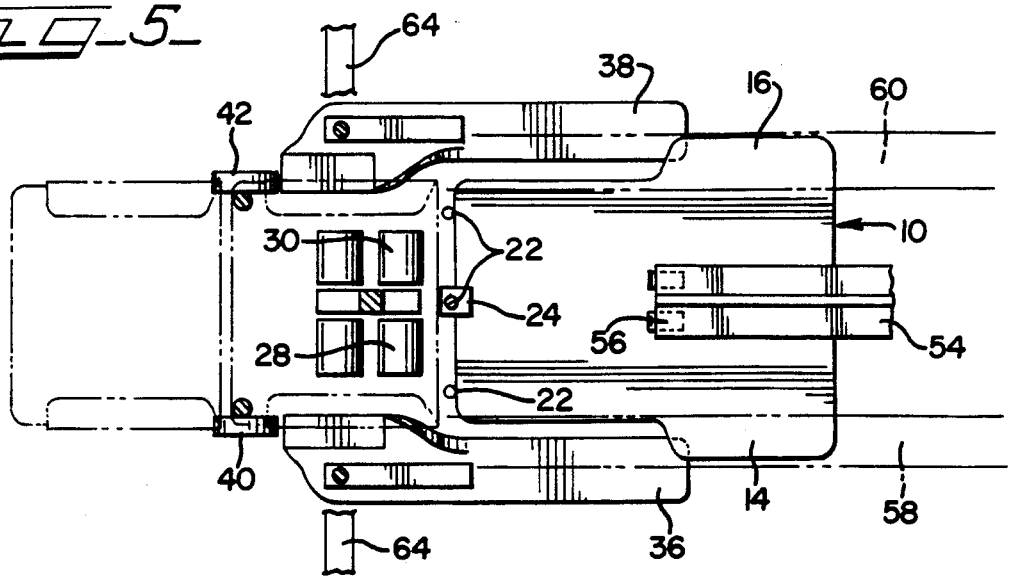
FIG. 5 is an overhead, perspective view of the present apparatus, as removably secured to a blank forming machine.

Also included as a part of the apparatus of the invention is a multi-rollered carriage 54. This various rollers 56 of this carriage 54 are powered to move the envelope blank 10 forward and to the buckle bar 22 of the present apparatus. In FIGS. 4–6, this carriage 54 is shown spaced considerably away from bar 46. In fact, the closest end of carriage 54 should be spaced approximately ½ inch from bar 46.

The present apparatus can fold and seal up to about seven hundred (700) blanks per minute. At this speed, the edges of the blanks 10 can flutter. To prevent such fluttering, paper guides 58 and 60 adjacent to and on either side of the carriage 54 are included as a part of the apparatus of the invention. As the envelope blank 10 is moved towards the present apparatus by the carriage 54, these paper guides 58 and 60 both overlie and stabilize the blank 10.

The frame of the Smith RA-800 blank forming machine generally includes a gum die trough having a concave section. This gum die trough is replaced by a flat folder plate (not shown) which keeps the envelope blanks flat as those blanks move through the plow shears. In the preferred embodiment, the components that work together to form the inventive apparatus are attached to a cross-bar frame. In this way, the apparatus is readily removable from the blank forming machine. The cross-bar 64 secures the present apparatus to the blank forming machine. In particular, the cross-bar 64 is secured with a pair of bolts 66 and 68 to the machine. In order to place the present apparatus in the appropriate position on the RA-800, certain components of that machine must first be removed. These components include the back seam gum box, the gum die shaft, and the roller carriage assembly.

The operation of the present apparatus may best be understood by reference to FIGS. 2, 3, 5 and 6. As may be seen in FIG. 2, flat envelope blank 10 is advanced towards the buckle bar 22 of the apparatus by the rollers 56 of the multi-roller carriage 54. As the leading edge 12 of the blank 10 approaches that buckle bar 22, the teflon tabs 44 lift that edge 12 upwardly. Air passing through the orifices 52 of the air supply plenum 50 move through the corresponding orifices 48 of the orifice-containing bar 46 and lift the edge 12 further. As the blank 10 is advanced still further, its leading edge 12 moves upwardly along the three elements of the buckle bar 22.

Figure 3:
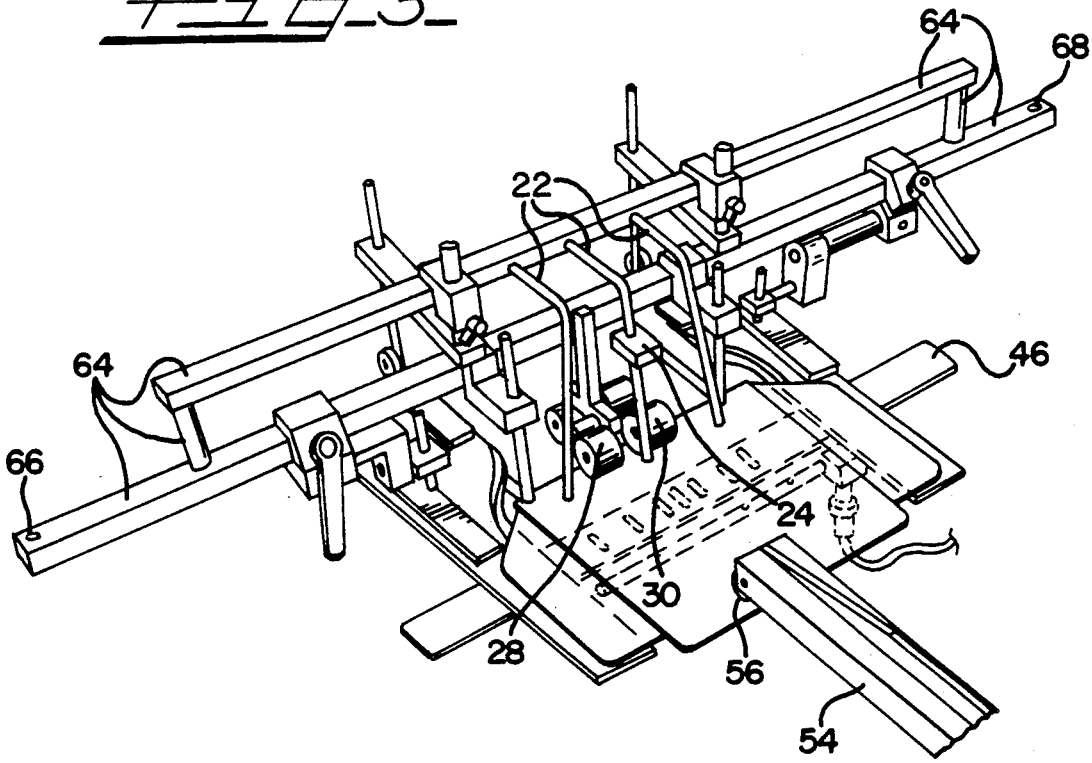
FIG. 3 is a perspective view of an envelope blank as friction drive rollers fold the rear portion of the envelope blank to a position overlying the front portion of that blank.

When the leading edge 12 reaches the adjustable stop 24, its direction is reversed. Particularly, the leading edge 12 of the blank 10 begins to move away from the buckle bar 22. Immediately thereafter, friction drive rollers 28 and 30 engage part of the rear portion 18 of the blank 10, and begin folding that rear portion 18 in such a manner that it overlies the front portion 20 (FIG. 3). It will be understood by those skilled in the art that this stop 24 should be raised to accommodate longer blanks, and lowered to accommodate shorter blanks.

As the blank 10 is further advanced, its side flaps 14 and 16 are engaged by a pair of folder blades 32 and 34, respectively. These folder blades lift the side flaps 14 and 16 so that those uplifted flaps may enter slots in the plow shears 36 and 38. The plow shears 36 and 38 then fold the side flaps 14 and 16 over the rear portion 18 of the blank 10.

Figure 7:
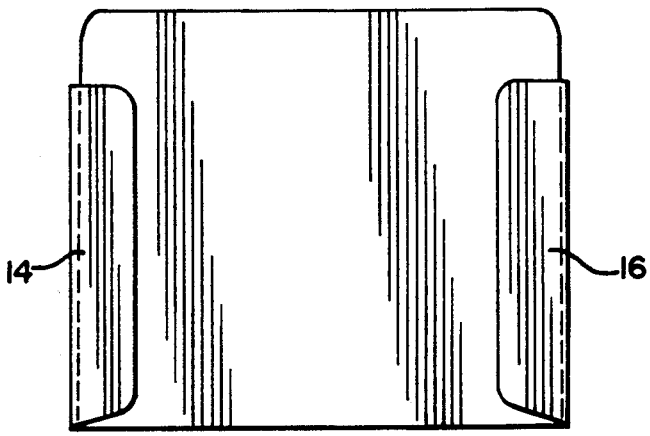
FIG. 7 is an overhead view of a completed envelope after processing by the apparatus of the invention.

As this folded blank 10 emerges from the main components of the apparatus, its side flaps 14 and 16 are engaged by crease rollers 40 and 42. These crease rollers both form a distinct crease in the side flaps 14 and 16 and secure those side flaps to the rear portion 18 of the blank 10. After engagement by the crease rollers, the blank is a fully folded and assembled envelope (FIG. 7). The apparatus in accordance with the invention has a capacity of 700 envelopes per minute, when used with the RA-800.

While the preferred embodiment has been illustrated and described, numerous modifications come to mind without markedly departing from the spirit of the invention. The scope of protection is thus only intended to be limited by the scope of the accompanying claims.

I claim:

1. In an envelope blank forming machine having means for forming the outline of an envelope blank before folding and means for feeding said envelope blank through said envelope blank forming machine, the invention being an apparatus that is removably attached to said envelope blank forming machine, said apparatus being used to form envelopes from said envelope, blanks said blanks including a leading edge, side flaps, a rear portion, and a front portion, and said apparatus comprising:

a. adhesive application means for applying adhesive on one side of said side flaps of said envelope blank;

b. a buckle bar for urging said leading edge of said envelope upwardly;

c. means for folding said rear portion to a position overlying said front portion;

d. means for folding said side flaps over said rear portion;

e. roller means for pressing the adhesive-covered side of said side flaps onto said rear portion to form an envelope; and f. a cross-bar frame being removably attached to the envelope blank forming machine, wherein said adhesive application means, said buckle bar, said means for folding said rear portion, said means for folding said side flaps and said roller means are attached to said removable cross-bar frame.

2. The apparatus as set forth in claim 1, wherein said adhesive application means comprises an adhesive sprayer.

3. The apparatus as set forth in claim 1, wherein said means for folding said side flaps comprises plow means.

4. The apparatus as set forth in claim 1, further comprising means for elevating said leading edge into engagement with said buckle bar, wherein said means for elevating is attached to said removable cross-bar frame.

5. The apparatus as set forth in claim 4, wherein said means for elevating comprises air lifting means.

6. The apparatus as set forth in claim 1, further comprising means for preventing said blanks from fluttering, wherein said means for preventing is attached to said removable cross-bar frame.

7. The apparatus as set forth in claim 6 wherein said means for preventing said blanks from fluttering comprises paper guide means.

8. In an envelope blank forming machine having means for forming the outline of an envelope blank before folding and means for feeding said envelope blank through said envelope blank forming machine, the invention being an apparatus that is removably attached to said envelope blank forming machine, said apparatus being used to form envelopes from said envelope blanks, said blanks including a leading edge, side flaps with an adhesive-covered side, a rear portion, and a front portion, and said apparatus comprising:

a. a buckle bar for urging said leading edge of said envelope blank upwardly;

b. means for folding said rear portion of said blank to a position overlying said front portion;

c. means for folding said side flaps over said rear portion;

d. roller means for pressing said adhesive-covered side of said side flaps onto said rear portion to form an envelope; and e. a cross-bar frame being removably attached to the envelope blank forming machine, wherein said buckle bar, said means for folding said rear portion, said means for folding said side flaps and said roller means are attached to said removable cross-bar frame.

9. In an envelope blank forming machine having means for forming the outline of an envelope blank before folding and means for feeding said envelope blank through said envelope blank forming machine, the invention being an apparatus that is removably attached to said envelope blank forming machine, said apparatus being used to form envelopes from said envelope blanks, said blanks including a leading edge, side flaps, a rear portion, and a front portion, and said apparatus comprising:

a. an adhesive sprayer for applying adhesive on one side of said side flaps of said envelope blank;

b. a buckle bar fur urging said leading edge of said envelope blank upwardly;

c. air lifting means for lifting said leading edge into engagement with a buckle bar, said buckle bar urging said leading edge of said envelope blank upwardly, and for folding said rear portion to a position overlying said front portion;

d. plow means for folding said side flaps over said rear portion; and e. roller means for pressing the adhesive-covered side of said side flaps onto said rear portion to form an envelope.

f. a cross-bar frame being removably attached to the envelope blank forming machine, wherein said adhesive sprayer, said buckle bar, said air lifting means, said plow means and said roller means are attached to said removable cross-bar frame.

* * * * *